US012359535B2

(12) United States Patent
Candiani et al.

(10) Patent No.: US 12,359,535 B2
(45) Date of Patent: Jul. 15, 2025

(54) CONTINUOUS CHOKE FOR DOWNHOLE VALVE

(71) Applicant: SCHLUMBERGER TECHNOLOGY CORPORATION, Sugar Land, TX (US)

(72) Inventors: Ivan Candiani, Taubate (BR); Bernardo Assis Criscolo De Melo Machado, Taubate (BR); Icaro Accordi, Taubate (BR); Cassius Elston, Taubate (BR); Eduardo Scussiato, Taubate (BR); Ali Bin Alsheikh, Dhahran (SA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/683,996

(22) PCT Filed: Sep. 23, 2022

(86) PCT No.: PCT/US2022/044593

§ 371 (c)(1),
(2) Date: Feb. 15, 2024

(87) PCT Pub. No.: WO2023/049389

PCT Pub. Date: Mar. 30, 2023

(65) Prior Publication Data

US 2024/0368966 A1 Nov. 7, 2024

Related U.S. Application Data

(60) Provisional application No. 63/261,538, filed on Sep. 23, 2021.

(51) Int. Cl.
*E21B 34/06* (2006.01)

(52) U.S. Cl.
CPC ..... *E21B 34/066* (2013.01); *E21B 2200/02* (2020.05)

(58) Field of Classification Search
CPC ..... E21B 34/066; E21B 2200/06
See application file for complete search history.

(56) References Cited

U.S. PATENT DOCUMENTS 5,979,558 A 11/1999 Bouldin
6,199,628 B1 3/2001 Beck
(Continued)

FOREIGN PATENT DOCUMENTS

WO 2000079094 A1 12/2000

OTHER PUBLICATIONS

Search Report and Written Opinion of International Patent Application No. PCT/US2022/044593 dated Jan. 10, 2023; 12 pages.

*Primary Examiner* — Brad Harcourt
(74) *Attorney, Agent, or Firm* — Jeffrey D. Frantz

(57) ABSTRACT

A continuous choke for a flow control valve is provided. The continuous choke can be included in a fully electric, full bore flow control valve. The continuous choke comprises a housing comprising at least one opening, a sleeve comprising at least one opening aligned with the at least one opening of the housing, a piston slidable relative to the sleeve to progressively cover or uncover the at least one opening of the sleeve to progressively decrease or increase, respectively, flow through the continuous choke, wherein the piston is configured to slide distally relative to the sleeve to move toward a closed position, the piston comprising a plurality of channels configured to direct fluid flow.

18 Claims, 12 Drawing Sheets

(56) References Cited

U.S. PATENT DOCUMENTS

| | | | | |
|---|---|---|---|---|
| 6,715,558 | B2 | 4/2004 | Williamson | |
| 7,377,327 | B2 | 5/2008 | Jackson | |
| 10,995,584 | B2 | 5/2021 | Noel | |
| 10,995,586 | B2 | 5/2021 | Gonzales Panta | |
| 2002/0020534 | A1 | 2/2002 | Wilson | |
| 2003/0159832 | A1 | 8/2003 | Williamson | |
| 2006/0151174 | A1 | 7/2006 | Cantin | |
| 2006/0284134 | A1* | 12/2006 | Dwivedi | F16K 5/0428 251/208 |
| 2018/0202251 | A1* | 7/2018 | El Mallawany | E21B 33/1212 |
| 2018/0223625 | A1* | 8/2018 | Noel | E21B 47/10 |

* cited by examiner

CONTINUOUS CHOKE FOR DOWNHOLE VALVE

CROSS-REFERENCE TO RELATED APPLICATIONS

The present application claims is a National Stage Entry of International Application No. PCT/US2022/044593, filed Sep. 23, 2022, which priority benefit of U.S. Provisional Application No. 63/261,538, filed Sep. 23, 2021, the entirety of which is incorporated by reference herein and should be considered part of this specification.

BACKGROUND

Field

The present disclosure generally relates to downhole flow control valves, and more particularly to a continuous choke for a downhole flow control valve.

Description of the Related Art

Oil and gas wells can include one or more downhole flow control valves (FCVs). FCVs can control the flow of fluid (e.g., hydrocarbons) from the exterior of the FCV to the interior of the FCV and into the production tubing string and/or the flow of fluid (e.g., injection fluid) from the interior of the FCV to the exterior of the FCV. FCVs operate via actuation means such as hydraulic, electric, and/or wireless technologies, or combinations thereof, and may not require mechanical intervention.

SUMMARY

In some configurations, a system for use in a well includes a full electric, full bore flow control valve including a continuous choke, and an electrically powered actuator. The continuous choke includes a housing comprising at least one opening; a sleeve comprising at least one opening aligned with the at least one opening of the housing; a piston slidable relative to the sleeve to progressively cover or uncover the at least one opening of the sleeve to progressively decrease or increase, respectively, flow through the continuous choke, wherein the piston is configured to slide distally relative to the sleeve to move toward a closed position, the piston comprising a plurality of channels configured to direct fluid flow; and one or more sealing features configured to help seal a volume outside the flow control valve from a volume inside the flow control valve when the piston is in the closed position. The actuator is operably connected to the piston and is configured to respond to electrical inputs to shift the piston to desired flow positions.

A portion of the piston including the plurality of channels can be or include tungsten carbide. At least a portion of the sleeve can be or include tungsten carbide. The piston can include an end piece coupled to a body portion. The channels can be formed in the end piece. The end piece and at least a portion of the sleeve that the end piece underlies in use can be or include tungsten carbide.

The plurality of channels can be angled to direct flow toward a center of an axial flow path through the choke. The one or more sealing features can include a metal seal. The metal seal can be disposed along an outer surface of the piston. The metal seal can be positioned proximal to the plurality of channels. The sleeve can include a sealing surface against which the metal seal seals when the choke is in a closed position. The sealing surface can be or include tungsten carbide. At least one of a radially outer perimeter of the at least one opening of the housing, a radially inner perimeter of the at least one opening of the sleeve, and a free end of the piston can have a rounded profile.

The actuator can be an electro-mechanical actuator (EMA). The flow control valve can be mounted along a well tubing. The flow control valve can have a flow area equivalent to an internal cross-sectional area of the well tubing.

A method of operating the system can include operating the actuator to cause translational movement of a drive shaft of the actuator, translational movement of the drive shaft causing translational movement of the piston to selectively adjust flow through the flow control valve.

In some configurations, a continuous choke for a flow control valve includes a housing comprising at least one opening; a sleeve disposed within the housing and comprising at least one opening aligned with the at least one opening of the housing; a piston disposed within and slidable relative to the sleeve to progressively increase or decrease flow through the choke, the piston comprising a plurality of channels configured to control fluid flow; and one or more sealing features configured to help seal a volume outside the flow control valve from a volume inside the flow control valve.

The piston can include an end piece coupled to a body portion. The plurality of channels can be formed in the end piece. The end piece can be or include tungsten carbide. At least one of a radially outer perimeter of the at least one opening of the housing, a radially inner perimeter of the at least one opening of the sleeve, and a free end of the piston can include a rounded profile. The continuous choke can further include at least one flow deflector configured to deflect flow through the at least one opening of the housing and the at least one opening of the sleeve away from at least one of the one or more sealing features.

A flow control valve including the continuous choke can be mounted along a well tubing, and can have a flow area equivalent to an internal cross-sectional area of the well tubing.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

Figure 1:
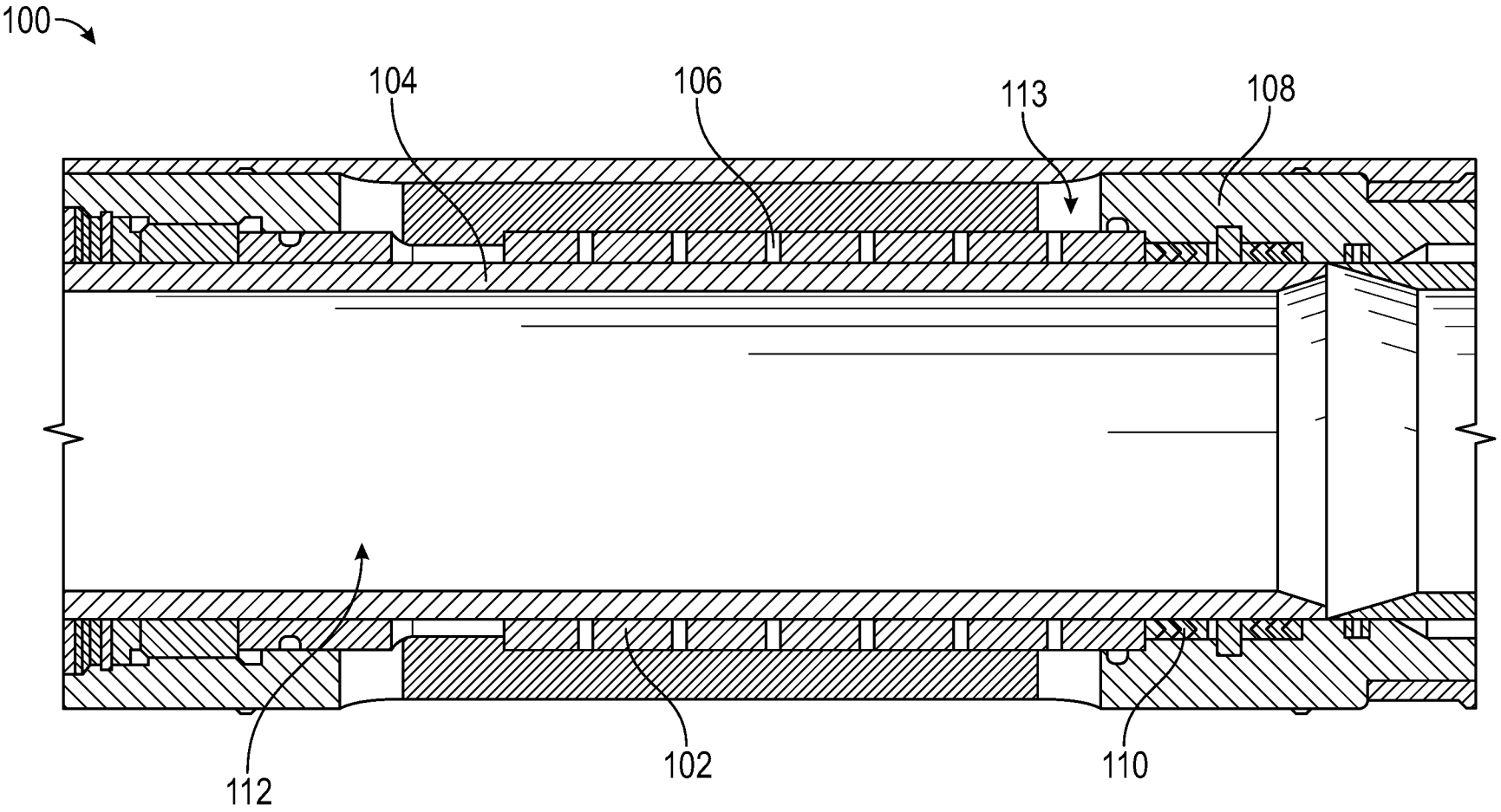
FIG. 1 shows an example traditional choke section of a flow control valve.

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

The present disclosure provides systems and methods for facilitating flow control downhole. In some configurations, such systems and/or methods include a continuous, or infinite, choke. In some configurations, systems and/or methods according to the present disclosure include a high flow rate, fully electric flow control valve (FCV). In other words, FCVs according to the present disclosure may include no hydraulic components.

In some configurations, systems and/or methods according to the present disclosure include full bore FCVs. A valve providing a flow area equivalent to the tubing inner cross-sectional area is referred to as a "Full Bore" valve. Traditional hydraulic full bore valves have an internal piston to control the amount of opening and flow through a choke. Given the size of the piston, sealing systems and bearings around the piston, substantial loads may be used to operate such a valve by overcoming the amount of friction generated by the dynamic and choke seals. Hydraulically operated valves can easily provide the desired load via a high hydraulic supply pressure and a large piston area. Converting such valves to an electric drive poses some challenges as the load provided by an electromechanical actuator is usually lower than what can be delivered by traditional hydraulic FCVs.

FCVs according to the present disclosure can include an actuator, such as an electro-mechanical actuator (EMA), and a sleeve or piston. The FCV can be actuated via translational movement or motion of the sleeve or piston. The EMA or other actuator can be mounted or coupled to the valve, for example, externally to the valve. The actuator can be coupled (e.g., physically or operably coupled) to the piston.

Flow control valves (FCVs) may rely on a sleeve or piston moving back and forth, e.g., up and down, to open or close hydraulic flow ports that selectively place the annulus (e.g., an area outside of the tubing) and the tubing in fluid communication. The FCV can be actuated among a plurality of fluid flow positions via an indexer. A valve actuator operably attached to the valve is able to position the valve at one or more positions including and/or between an open position and a closed position. In some existing valves, the valve actuator can define a predefined shifting sequence to provide incremental positions of the valve. The change in flow area as the valve is actuated through the incremental positions varies so that predetermined changes in flow condition can be provided. Flow condition may refer to pressure drop across the valve, flow volume, and/or flow rate through an orifice in the valve. The actuation mechanism and position indexing mechanism of the FCV may be located in an upper section of the FCV. Choking (or flow control) and sealing mechanisms and functions of the FCV are located and performed at the choke section.

FIG. 1 shows a choke 100 of a traditional FCV having an internal piston 104. As shown, the choke 100 may include a sleeve 102, which can be made of or include a hard material for erosion resistance, for example, carbide, and an inner piston 104, which in operation closes and/or opens ports 106 of the sleeve 102.

The piston 104 and sleeve 102 are disposed in a choke housing 108. The housing 108 can be a generally tubular body with a flow passage 112 extending axially therethrough. The housing 108 includes one or more openings 113 through (e.g., radially through) the body that place an exterior of the housing 108 in fluid communication with the flow passage 112. The choke sleeve 102 is disposed within the housing 108. In other words, the choke sleeve 102 is disposed radially within the housing 108. An outer or external surface of the choke sleeve 102 can be disposed adjacent and/or in contact with an inner or internal surface of the body of the housing 108. The choke also includes one or more seal stacks 110 that help seal the valve internal volume from external volume when the piston 104 is underneath the seals 110 in a full closed position or state of the choke. The choke seal(s) 110 can be made of metal.

Figure 2B:
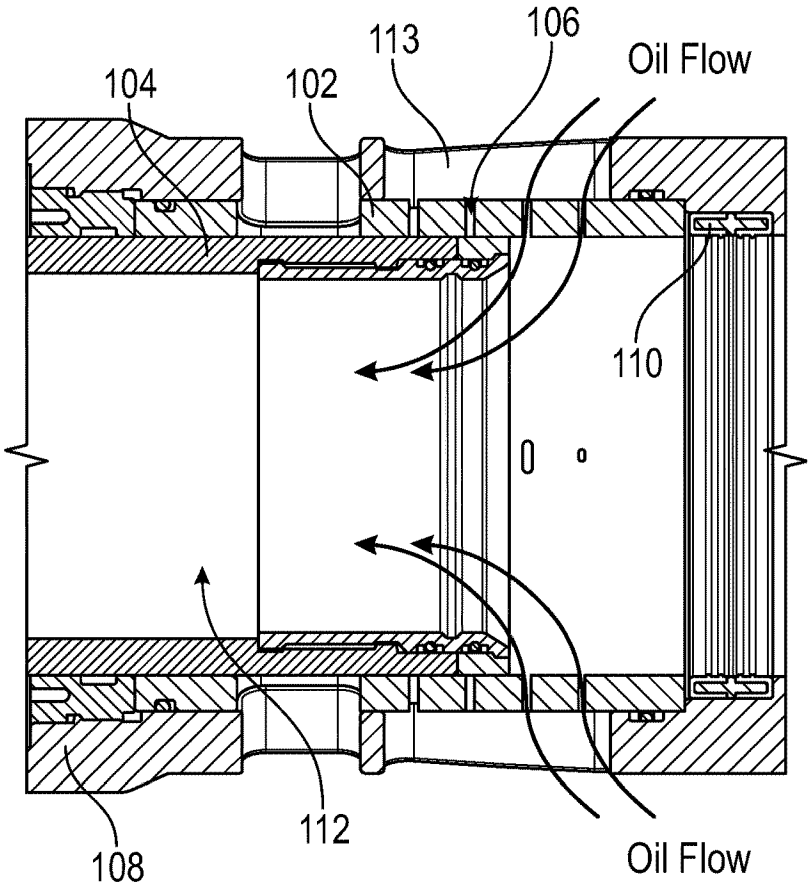
FIGS. 2A and 2B show an example traditional choke section at positions one and two, respectively.
Figure 2A:
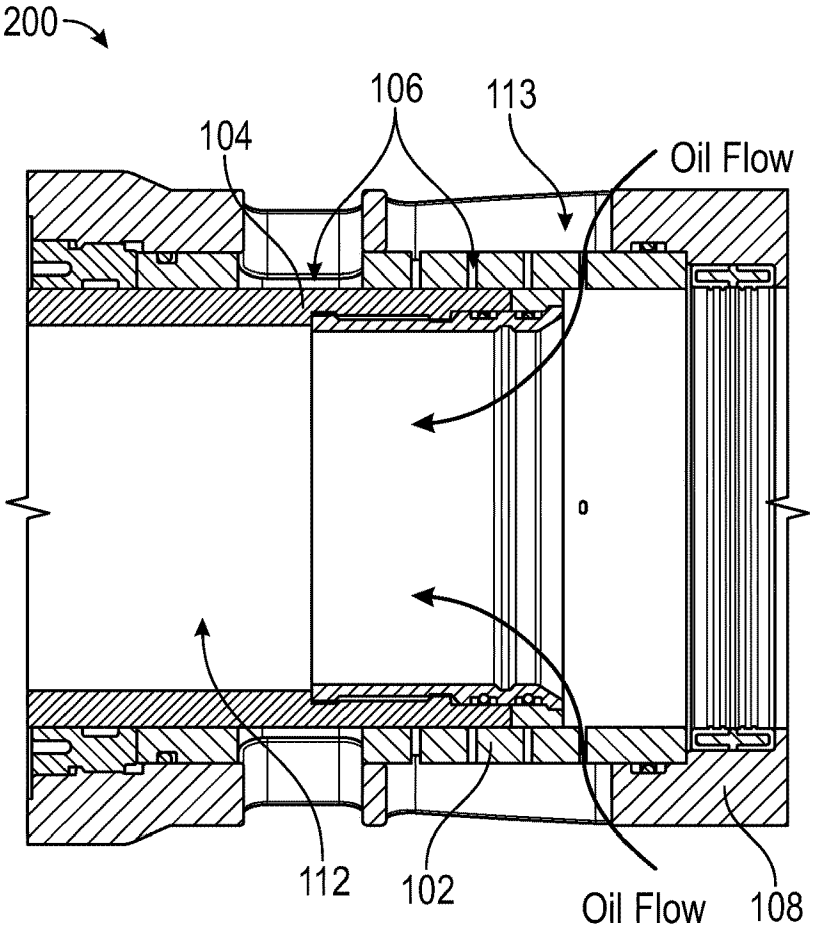

The choke sleeve 102 includes one or more, e.g., a series of, choking orifices 106. The choking orifices 106 underlie, or are aligned and in fluid communication with, the openings 113 in the body of the housing 108. Each of the series of choking orifices 106 corresponds to an intermediate position or state of the choke and dictate flow characteristics of the choke relative to position of the piston 104. In some configurations, all of the choking orifices 106 are the same or approximately the same size. In other configurations, for example as shown in FIGS. 2A and 2B, one or more of the choking orifices 106 can be larger than the others.

The piston 104 is slidably disposed within the choke sleeve 102. In other words, the piston 104 is disposed radially within the choke sleeve 102. An outer or external surface of the piston 104 can be disposed adjacent and/or in contact with an inner or internal surface of the choke sleeve 102. An inner or internal surface of the piston 104 can define the flow passage 112. The piston 104 is slidable relative to the choke sleeve 102 to selectively cover and uncover choking orifices 106 of the choke sleeve 102. The piston 104 can be stopped at or moved to various positions relative the choke sleeve 102 to regulate the choke characteristics and manage flow rate vs. differential pressure. The piston 104 can be one piece or two or more pieces integrally formed or coupled together. The piston 104 can be monolithic or, for example, can include a coating on a portion or entirety of the piston 104.

In a full open position or state of the choke, the piston 104 is retracted or moved such that all of the choking orifices 106 are uncovered and in fluid communication with the flow passage 112. The flow passage 112 is therefore in fluid communication with the exterior of the choke via the choking orifices 106, and openings 113 in the body of the housing 108. At the full open position, the piston 104 allows a maximum flow path for letting fluid travel across the choke while minimizing pressure losses. In a full closed position or state of the choke, the piston 104 is extended or moved such that all choking orifices 106 are covered by the piston and not in fluid communication with the flow passage 112. The flow passage 112 is therefore not in fluid communication with the exterior of the choke. At the full closed position, the piston 104 lodges underneath the seal stack 110 to seal off the internal volume of the valve (tubing volume) from the external volume (annulus). The piston 104 can also be moved to a plurality of intermediate positions between the full open and full closed positions in which some of the choking orifices 106 are covered. For example, as the piston 104 moves from the full closed position toward the full open position, more of the choking orifices 106 are progressively uncovered such that fluid flow between the exterior of the choke and the flow passage 112 gradually increases. In some configurations, the extremity or end of the piston 104 can include a hard coating and/or be made of highly erosion resistant material to withstand the flow of fluid charged with particulates while minimizing erosion damage.

Traditional chokes, such as the example choke 100 of FIG. 1, have a plurality of discrete, axially spaced, calibrated ports 106 for choking flow into or out of the valve. The area of each discrete port 106 is typically defined according to the specific application. Therefore, during operation, only predefined openings or flow area or volume can be selected. For example, FIGS. 2A and 2B show an example traditional discrete choke at choke or flow positions one and two (in other words, FIG. 2A shows the piston 104 positioned relative to the sleeve 102 such that one choking orifice 106 is uncovered and allows fluid flow therethrough, and FIG. 2B shows the piston 104 positioned relative to the sleeve 102 such that two choking orifices 106 are uncovered and allow fluid flow therethrough. Such predefined discrete choke positions are typically needed in traditional FCVs that rely on hydraulic actuation mechanisms, which tend to lack precision on the stroke position of the choke and therefore require a hard stop for each position.

Figure 3B:
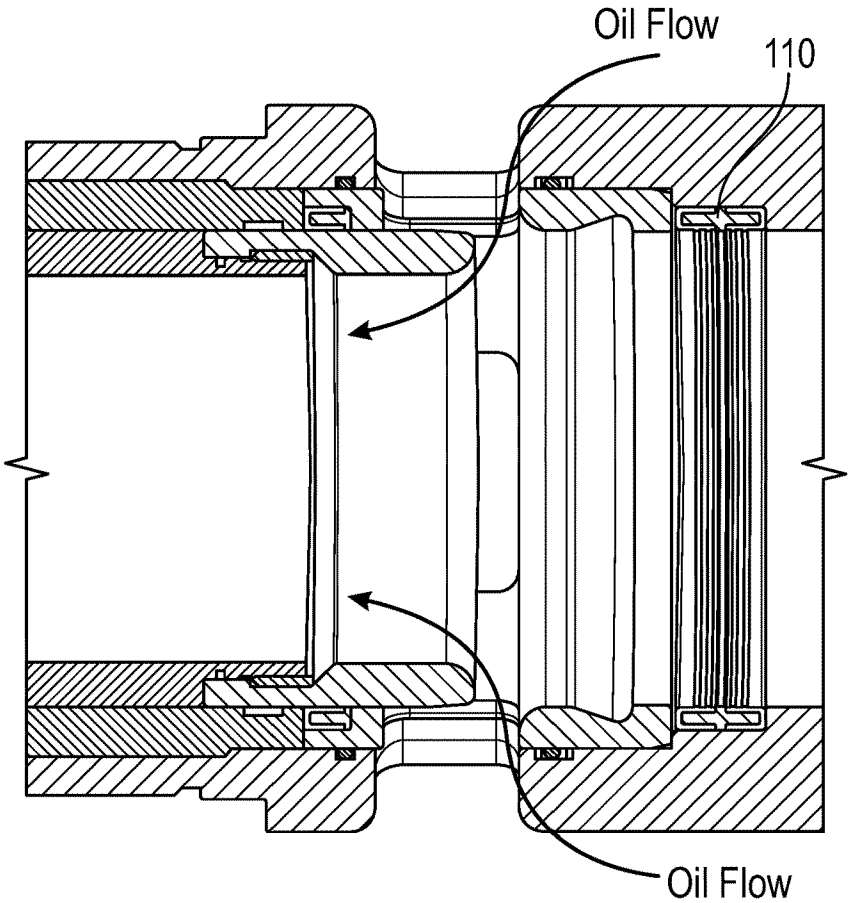
FIGS. 3A and 3B show an example continuous choke section at two positions.
Figure 3A:
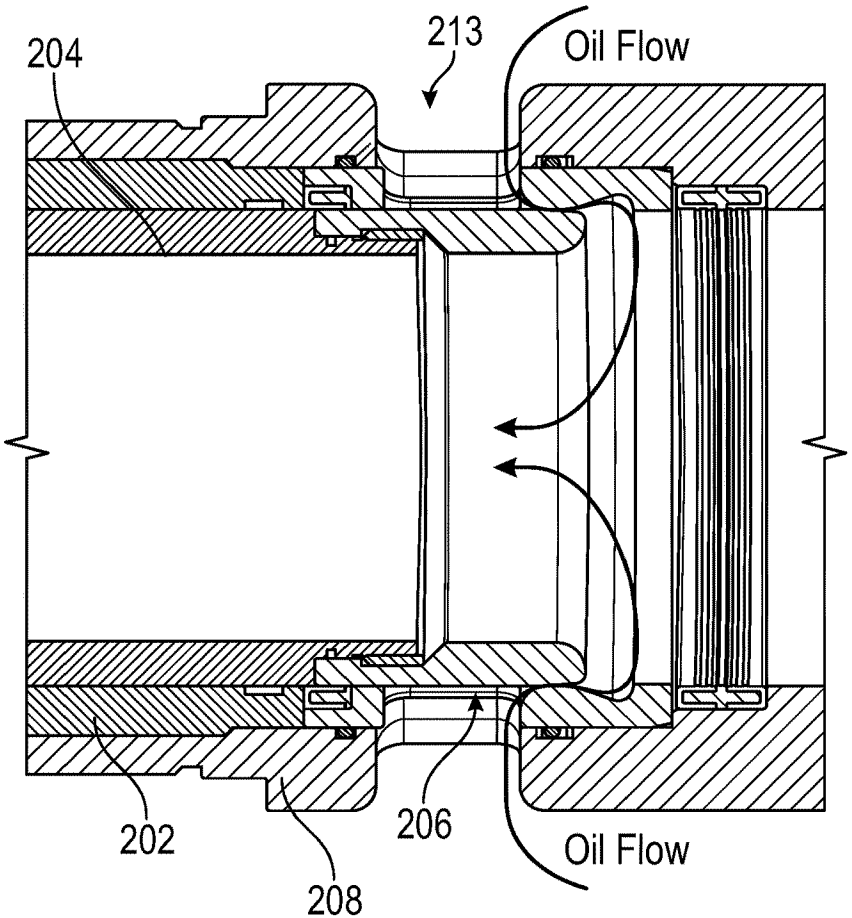

Systems and methods according to the present disclosure include a continuous choke. For example, FIGS. 3A-3B show an example continuous choke 200. The continuous choke includes a sleeve 202 and a piston 204 disposed in a housing 208. In the illustrated configuration, the piston 204 is disposed within the sleeve 202. The housing 208 includes an opening 213, and the sleeve 202 includes an opening 206 underlying and/or aligned with the opening 213 of the housing 208. In operation, the piston 204 closes and/or opens opening 206 of the sleeve 202.

In a traditional choke, the sleeve 102 has a plurality of relatively smaller axially spaced openings 106, and the piston 104 has a set number, for example 4-6, of discrete positions relative to the sleeve 102 between fully closed and fully open. In contrast, in the continuous choke, the sleeve 202 has a relatively larger opening 206 (or a plurality of openings 206 spaced about a circumference of the sleeve 202), and the piston 204 can move among a continuous range of positions relative to the sleeve 202. The relatively larger opening 206 in the sleeve 202 of the continuous choke can advantageously be less prone to becoming clogged, e.g., by scale, over time compared to the smaller openings 106 in a traditional choke. FIGS. 3A-3B show the continuous choke with the piston 204 positioned to allow relatively less flow (FIG. 3A) and with the opening 206 partially uncovered to allow relatively more flow (FIG. 3B). Fully electric flow control valves can advantageously allow for more precise piston 204 positioning and stroke actuation, which enables fine control of the opening area in a FCV having a continuous choke.

In use, a FCV controls production or injection flow in a well. In some cases, production is started with the FCV choke in the full or 100% open position. Over time, the reservoir may start to produce water. The choke can then be partially closed to find a valve position at which the well stops producing water. In some FCVs, the choke may include discrete intermediate choke positions between full open and full close with choking orifices 106 sized such that flow is decreased to, for example, 20%, 15%, 10%, and 5% of the 100% full open position as the piston 104 is moved to cover and close 1, 2, 3, and 4 of the openings 106, respectively. The continuous choke can advantageously allow the operator to find an optimized or improved choke position that maximizes oil flow without production of water.

Figure 4:
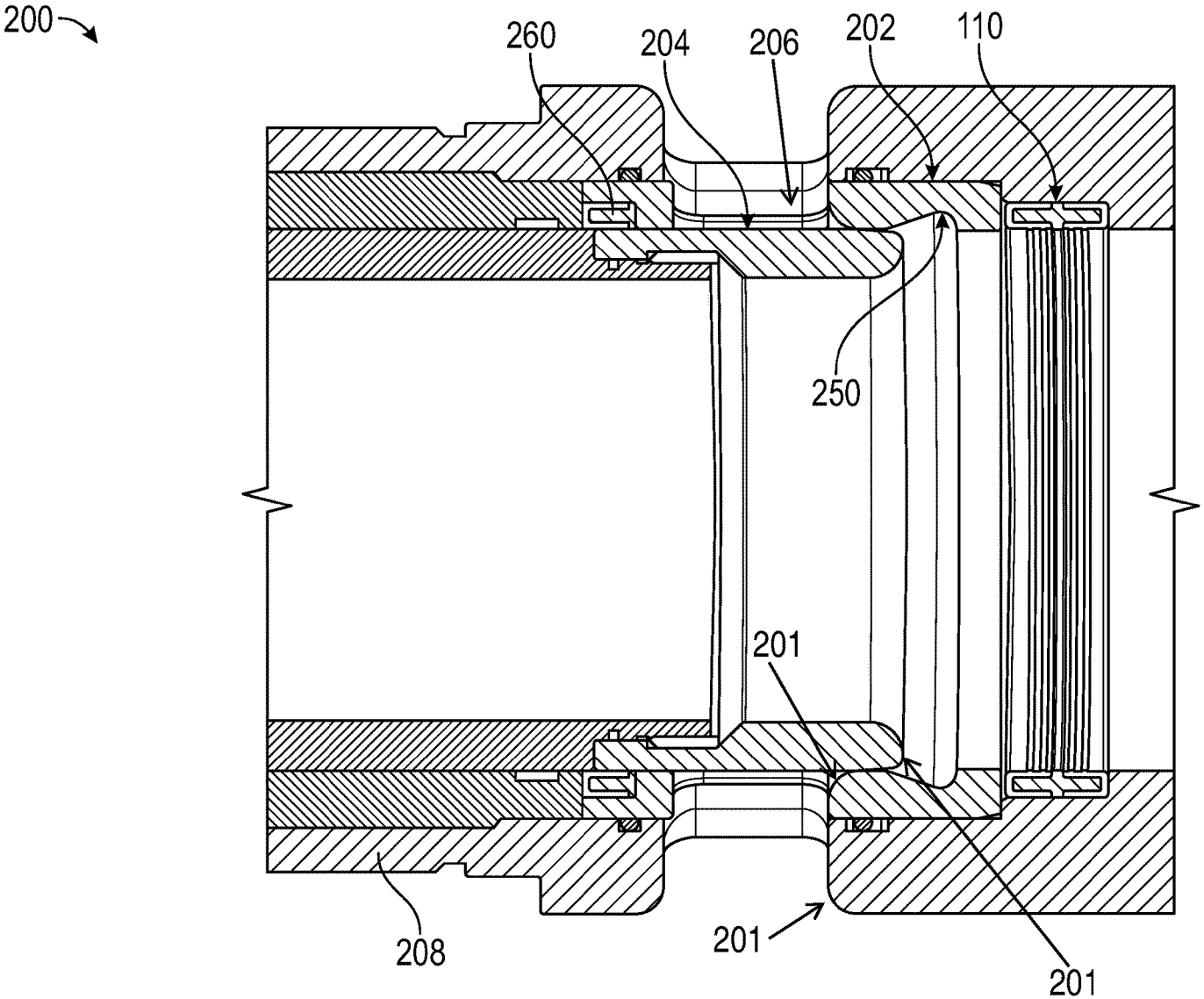
FIG. 4 shows an example continuous choke section.
Figure 5:
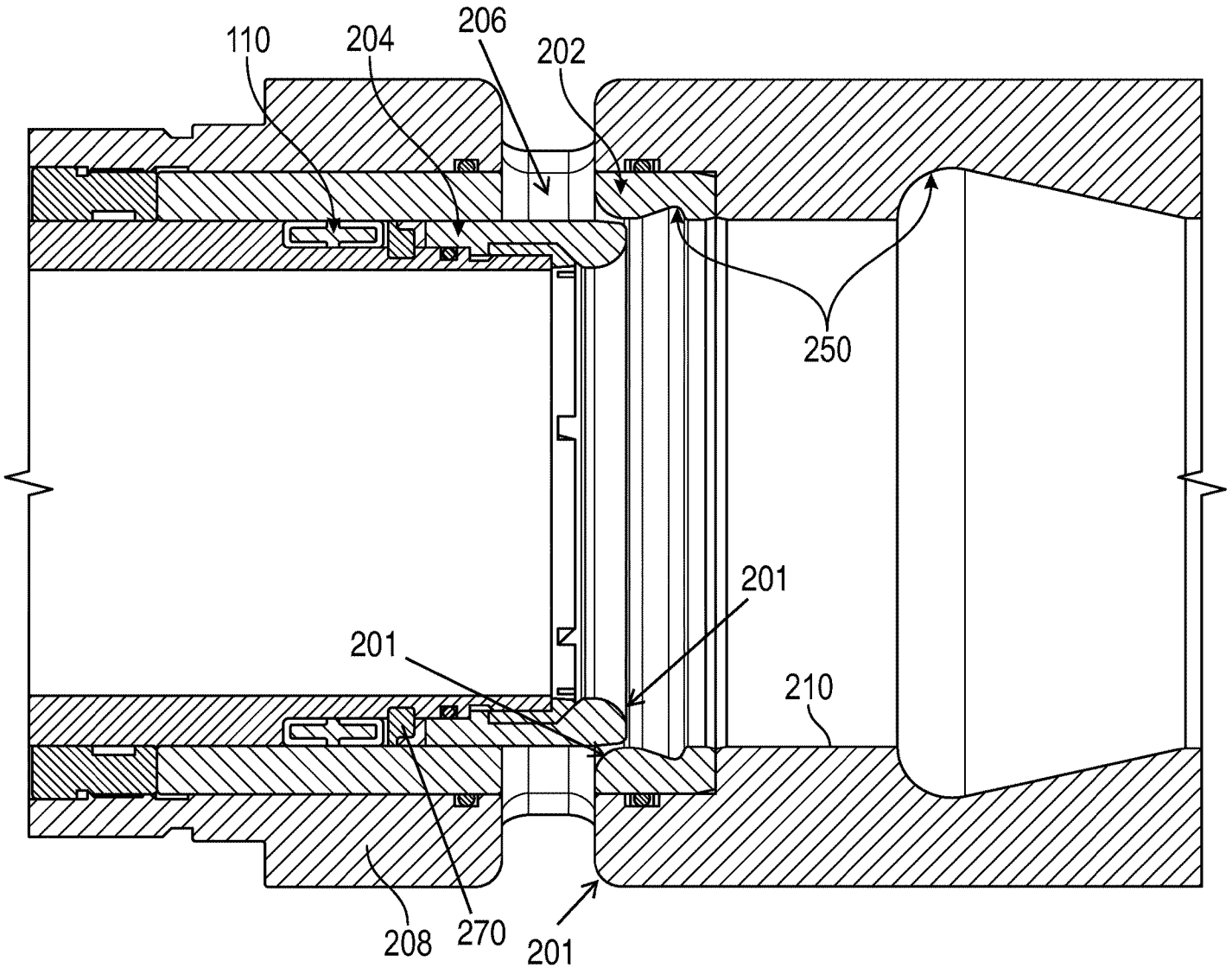
FIG. 5 shows another example continuous choke section.
Figure 6A:
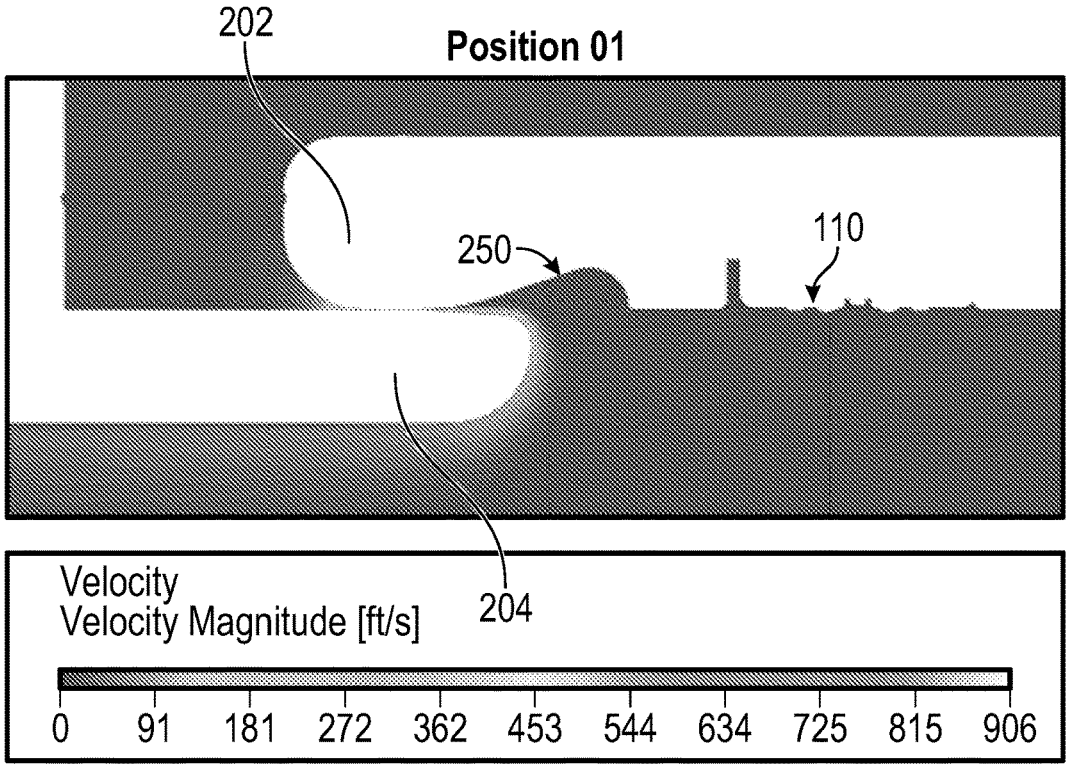
FIGS. 6A-6D show various flow velocity profiles of a continuous choke.
Figure 6B:
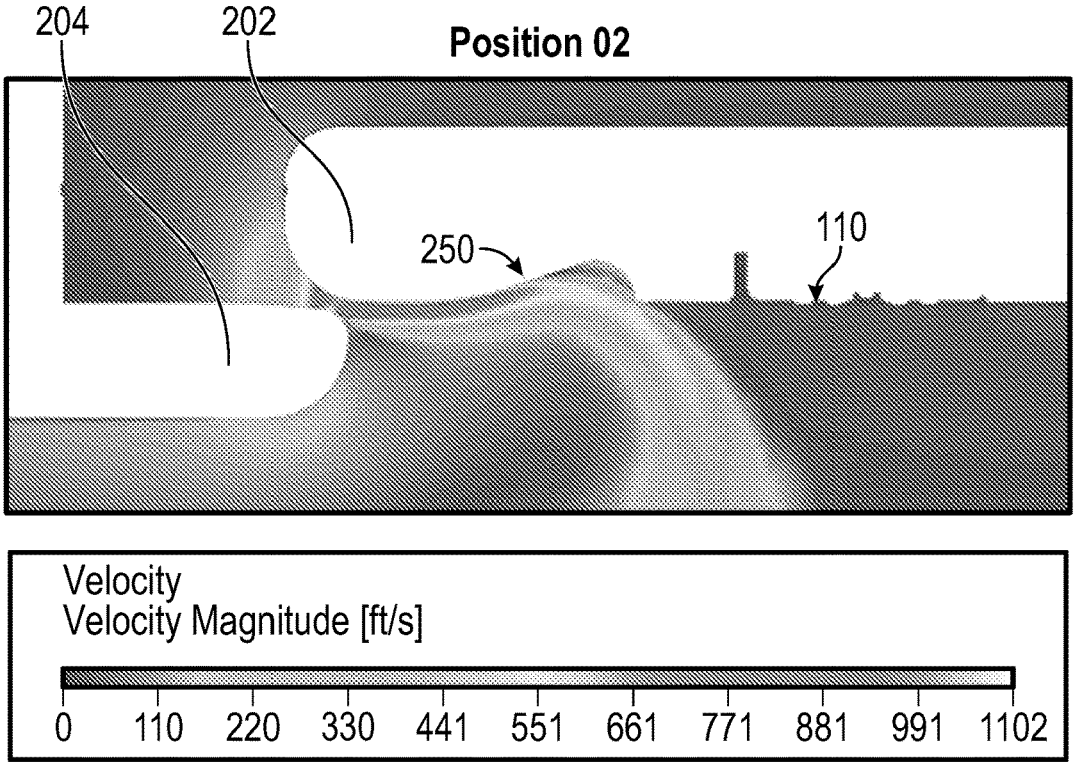
Figure 6C:
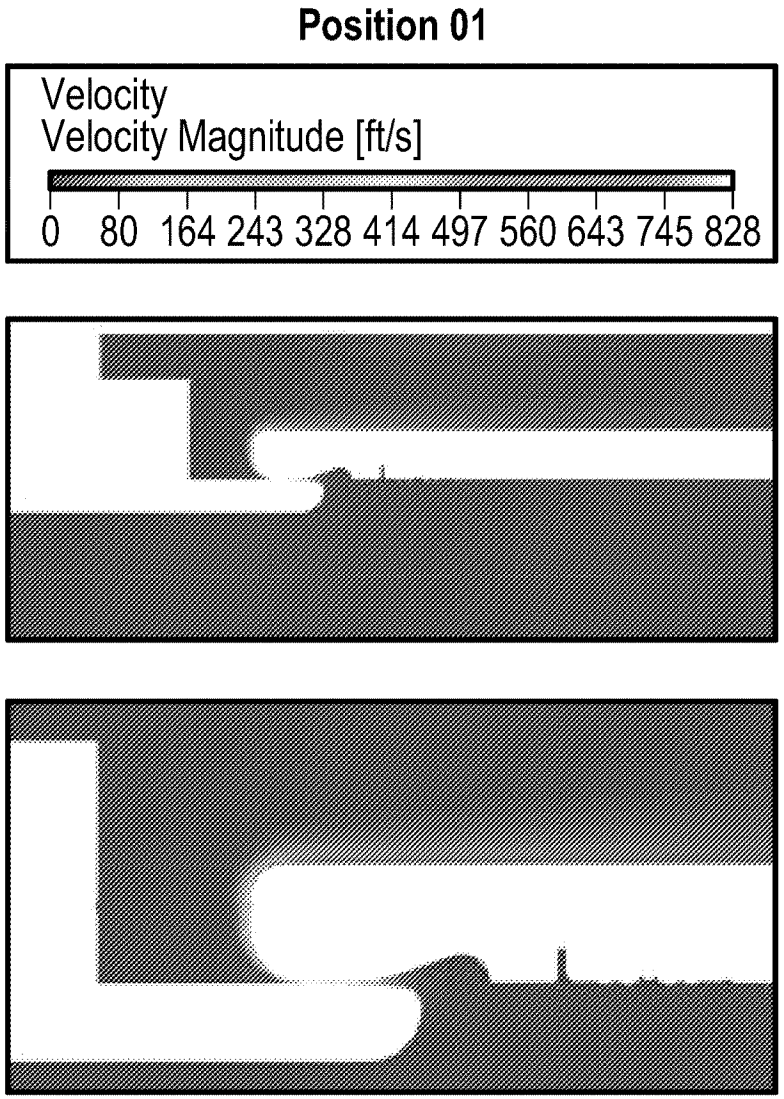
Figure 6D:
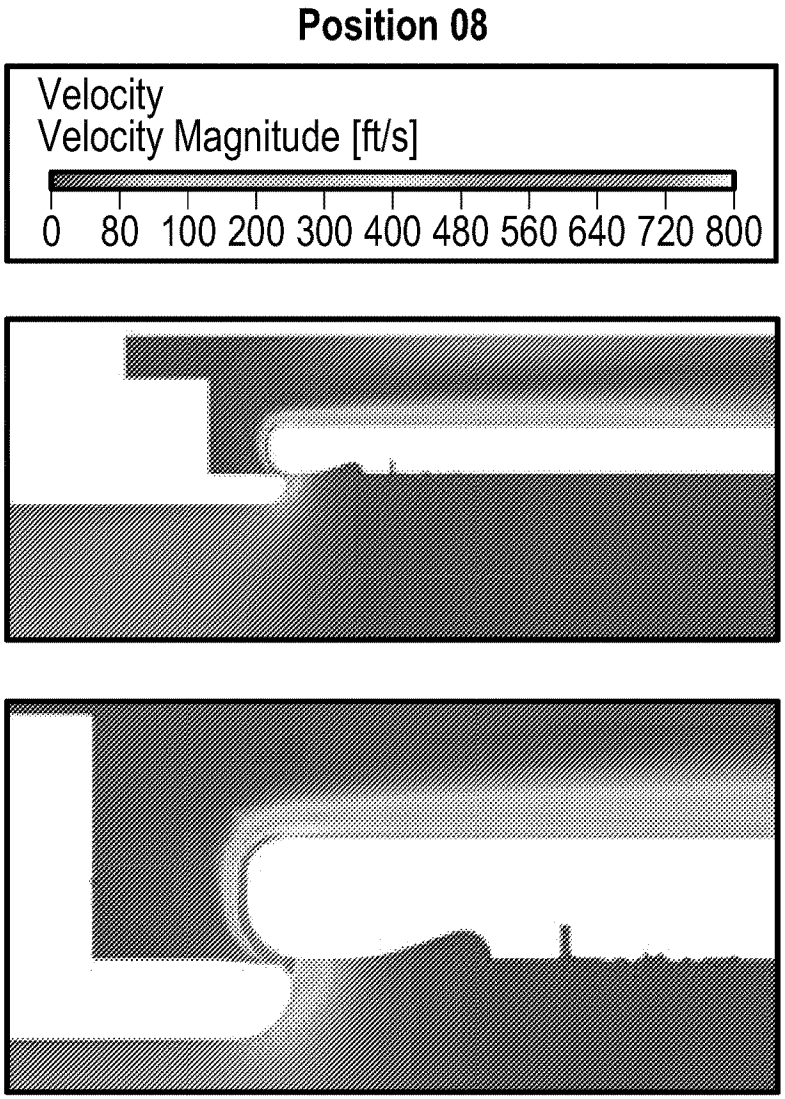

FIGS. 4 and 5 show example continuous choke designs according to the present disclosure. As shown, the continuous choke 200 includes an inner sleeve or piston 204 disposed within (e.g., radially within) an outer sleeve or sleeve 202. The outer sleeve 202 includes one or more flow windows or openings 206. In some configurations, the outer sleeve 202 includes four flow windows 206, which may be positioned at 900 intervals about the circumference of the sleeve 202. The two sleeves have simple geometries, advantageously resulting in low stress concentrations and allowing high differential pressures. The inner and/or outer sleeve can be made of or include materials with high resistance to erosion, such as carbides. Either or both of the sleeves can be single piece or monolithic, or can be or include two components coupled together as shown.

In the configurations of FIGS. 3A-4 and 7-9, the metal seal 110 is positioned axially aligned with and adjacent or proximate the end (distal end, or toward the right in the orientation of the figures) of the sleeve 202. As shown, the metal seal 110 can be disposed in a recessed portion or cavity in the inner surface of the housing 208. FIG. 5 illustrates an alternative configuration in which the metal seal 110 is disposed along the inner sleeve 204, for example, in a cavity or recess in the outer surface of the piston 204 as shown. The housing 208 includes a sealing area 210. In the illustrated configuration, the sealing area 210 is a portion of the inner surface of the housing 208 positioned adjacent the end of the sleeve 202. When the piston 204 is in a closed position (extended to the right of FIG. 5), the metal seal 110 can be placed adjacent and seal against the sealing area 210. This configuration can advantageously help protect the metal seal 110 from flow, and possible erosion, at all times.

The flow inlet and/or outlet areas of the continuous choke 200 have big rounds (e.g., rounded profiles) 201, designed to help guide the flow as tangentially as possible to the sleeves, which can help deviate flow away from the seal 110, thereby resulting in less erosion even at high flow rates. As shown in FIGS. 4-5 and 8-10, big rounds 201 can be formed on the housing 208 about a perimeter of the opening 213 (e.g., on or in a radially outer surface of the housing 208), on the sleeve 202 about a perimeter of the opening 206 (e.g., on or in a radially inner surface of the sleeve 202), and/or on a free distal end of the piston 204.

Figure 9:
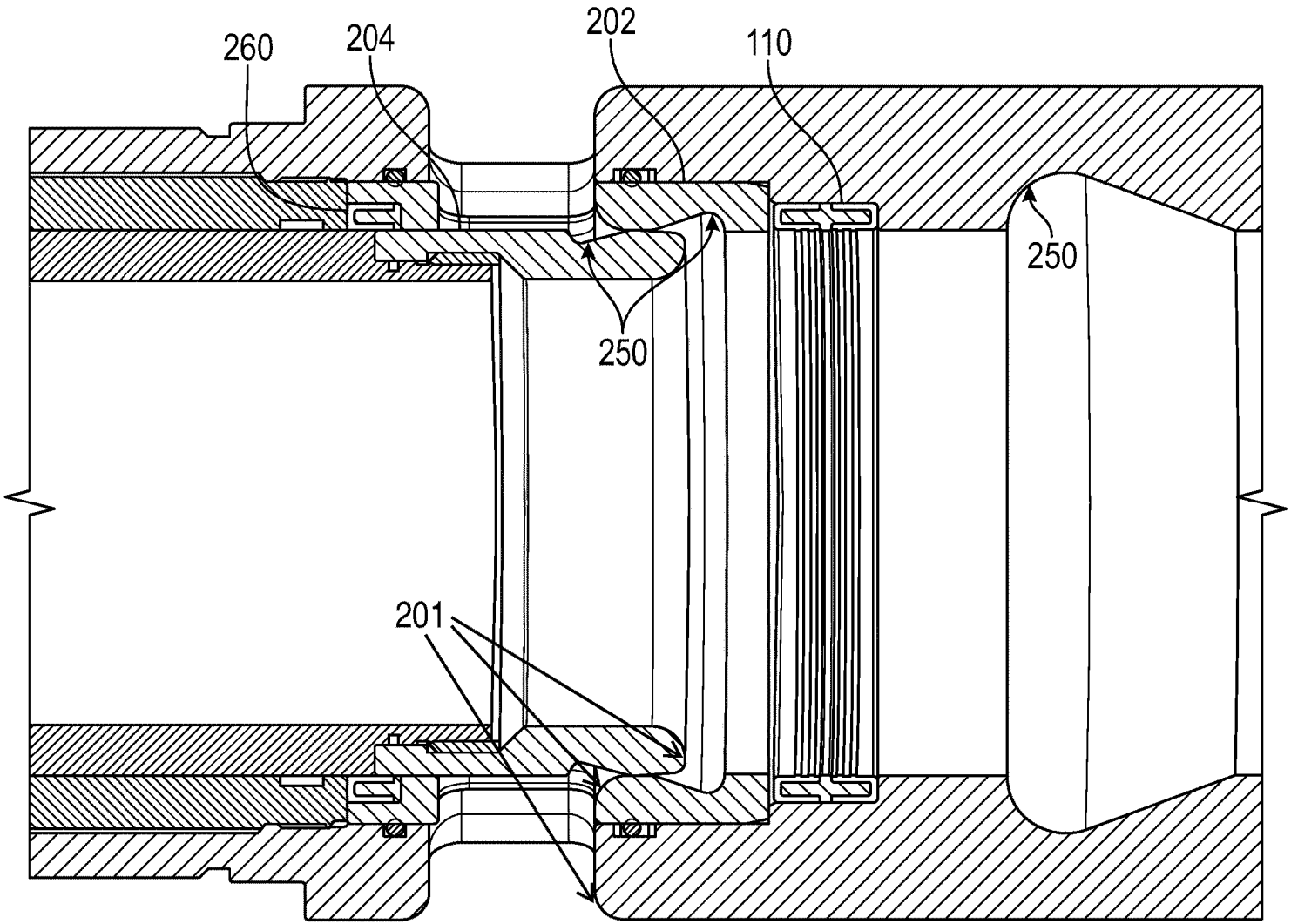
FIG. 9 shows another example continuous choke section.

In some configurations, the continuous choke 200 includes one or more flow deflectors 250. The configuration of FIG. 4 includes a flow deflector 250 proximate the end of the sleeve 202 (e.g., an end of the sleeve 202 proximate the seal 110. As shown, the deflector 250 is a rounded recessed portion or cutout in an inner surface of the sleeve 202. The configurations of FIGS. 5 and 9 include a deflector 250 proximate the end of the sleeve 202, and a second deflector 250 in an inner surface of the housing 208. The second deflector 250 is positioned distal to (toward the right side of FIG. 5) and spaced from the ends of the sleeve 202 and piston 204. In the configuration of FIG. 5, the second deflector 250 is positioned adjacent an end of the sealing area 210 opposite the end of the sleeve 202. In other words, the sealing area 210 of the configuration of FIG. 5 is positioned between (axially between) the end of the sleeve 202 and the second deflector 250. FIG. 9 illustrates a configuration of a continuous choke 200 including a third deflector 250 in an outer surface of the piston 204. As shown, the third deflector 250 may be near the end of the piston 204.

The flow deflector(s) 250 can be positioned proximate the flow inlet or outlet areas to take advantage of the Coanda Effect, in which fluid flow attaches to a nearby surface, and remains so attached, even when the surface curves away from the original direction of the fluid flow. The flow deflector(s) 250 can take advantage of this effect to deviate the jet flow away from regions of the choke 200 that are less resistant to erosion, such as the metal seals 110 or other sealing areas, e.g., sealing area 210. Deflecting fluid away from such areas can help protect them from erosion.

FIG. 6 shows flow velocity profiles of flow through the opening 206 in the sleeve 202 and shows the Coanda Effect caused by the deflector 250. FIG. 6A shows the flow velocity profile during production when the piston 204 of the choke is in the position shown in FIG. 3A, and FIG. 6B shows the flow velocity profile during production when the piston 204 of the choke is moved to a relatively more open position. FIG. 6C shows the flow velocity profile during injection when the piston 204 of the choke is in the position shown in FIG. 3A, and FIG. 6D shows the flow velocity profile during injection when the piston is moved to the position of FIG. 6B.

As shown, the first deflector 250 diverts flow through the opening 206, for example, production flow flowing into the tubing, away from the seal 110. The second deflector 250 in the housing 250 can advantageously help direct upstream production fluid (flowing in an uphole direction or from the right toward the left in the orientation of the figures) away from the seal 110 and/or sealing area 210. In some configurations, the third deflector 250 in the outer surface of the piston 204 can help direct injection flow from inside the tubing flowing out through the choke away from the seal 110 and/or sealing area 210. The big rounds 201 can also utilize the Coanda Effect to guide flow such that the jets are tangent to the surfaces.

Figure 7:
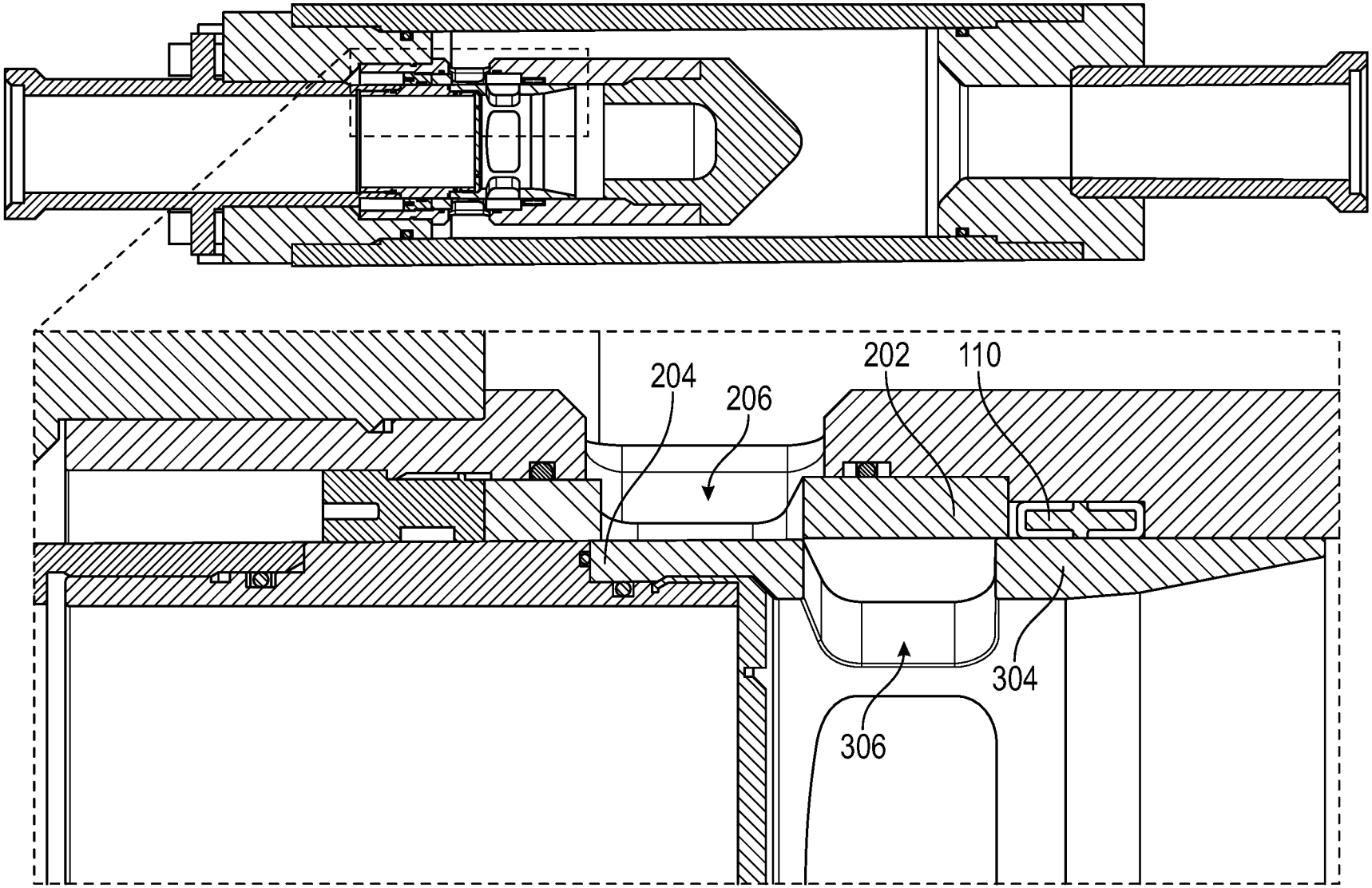
FIG. 7 shows another example continuous choke section.

FIG. 7 illustrates another example continuous choke in which the end of the piston 204 includes a seal cover portion 304. As shown, the piston 204 includes an opening 306 between (axially between) the seal cover portion 304 and a main body of the piston 204. As the piston 204 is moved relative to the sleeve 202 in use, the percentage of the opening 306 that is aligned with the opening 206 of the sleeve 202 increases or decreases, thereby increasing or decreasing, respectively, the volume of flow through the valve. The seal cover portion 304 can advantageously help protect the seal 110 from erosion. In the illustrated configuration, the piston 204 includes or is made of multiple components, and the seal cover portion 304 and the opening 306 are formed in an end piece component.

Figure 8:
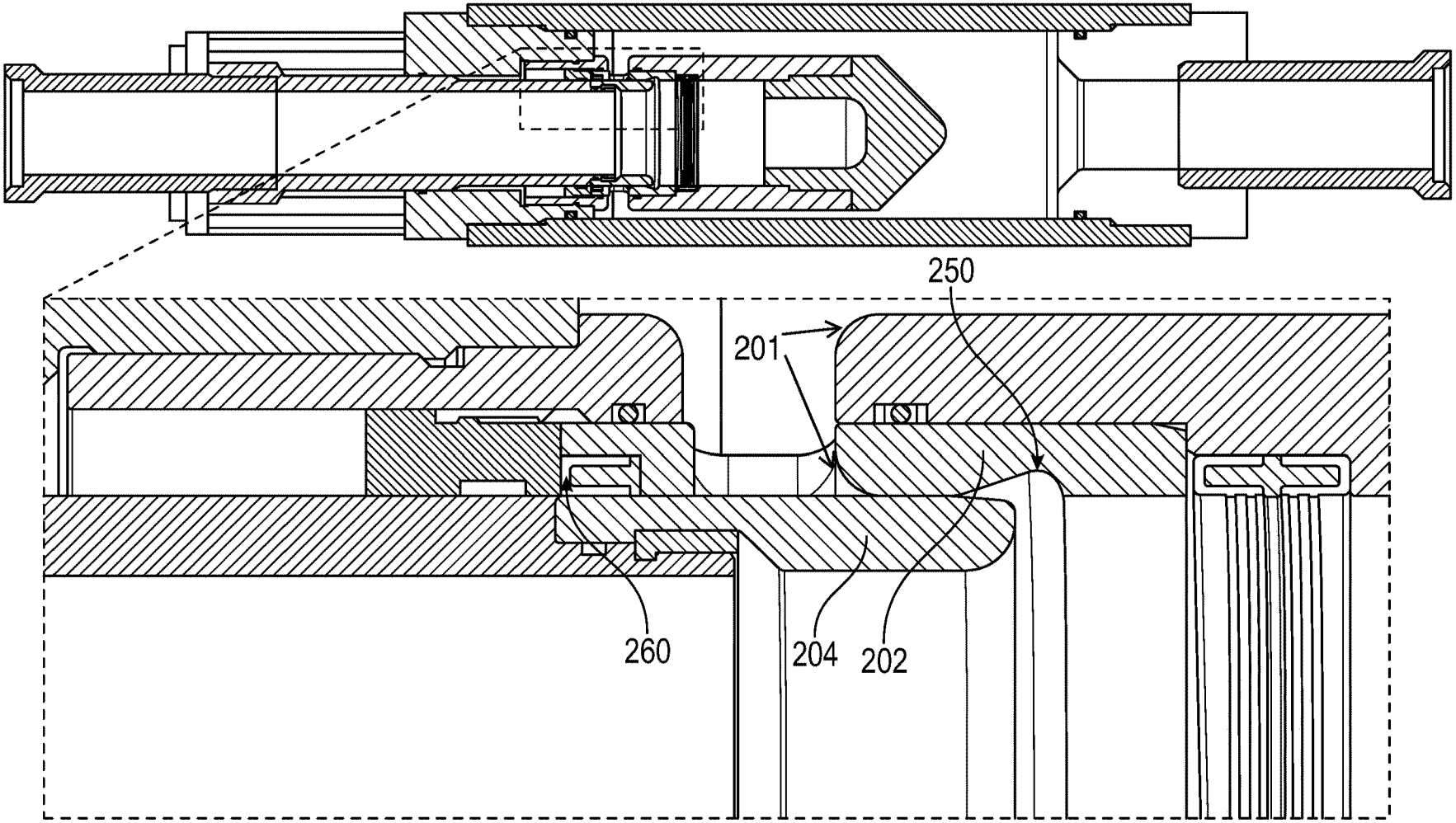
FIG. 8 shows another example continuous choke section.

In some configurations, for example as shown in FIGS. 8 and 9, the choke 200 includes a centralizing ring 260. As shown, the centralizing ring 260 is positioned radially between the piston 204 and at least a portion of the sleeve 202. In the illustrated configuration, the centralizing ring 260 is positioned in a recess or cavity formed in the inner surface of the sleeve 202, such that the centralizing ring 260 is surrounded on three sides by portions of the sleeve 202. Without a centralizing ring 260, a radial gap between the piston 204 and sleeve 202 may be eccentric. An area having a larger or thicker gap between the piston 204 and sleeve 202 may be more prone to high erosion rates compared to an area having a smaller or thinner radial gap. The centralizing ring 260 can advantageously help centralize the piston 204 within the sleeve 202 and reduce eccentricity of the radial gap between the sleeve 202 and piston 204 (and keep the radial gap uniform or substantially uniform about the circumference of the sleeve), which can in turn advantageously help reduce erosion, for example as may occur in regions having a larger radial gap between the piston 204 and sleeve 202 due to eccentricity.

In the configuration of FIG. 5, in which the seal 110 is disposed along or in the outer surface of the piston 204, the seal 110 can also act as a centralizing ring to help centralize the piston 204 relative to the outer sleeve 202 such that the radial gap between the piston 204 and sleeve 202 is uniform about the circumference of the sleeves. The configuration of FIG. 5 also includes a splitted ring 270. The splitted ring 270 helps hold the metal seal 110 in place without transferring load to the inner sleeve 204.

Figure 11:
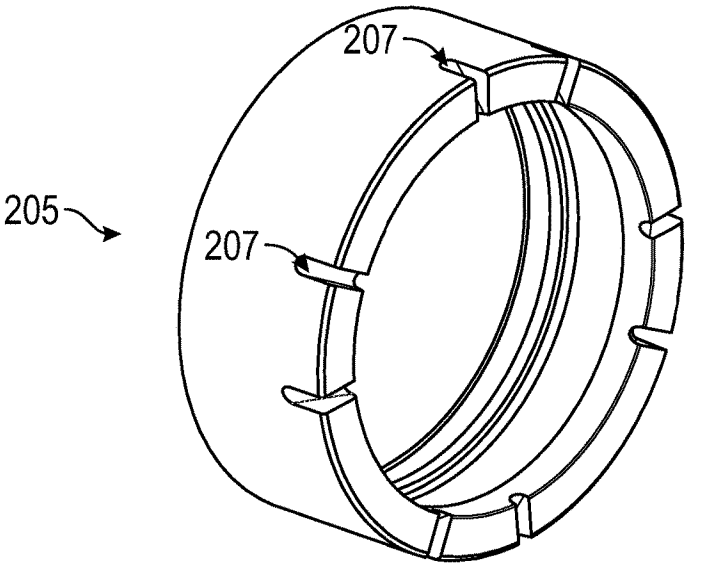
FIG. 11 shows a perspective view of an end piece of the piston of the continuous choke of FIG. 10.
Figure 10:
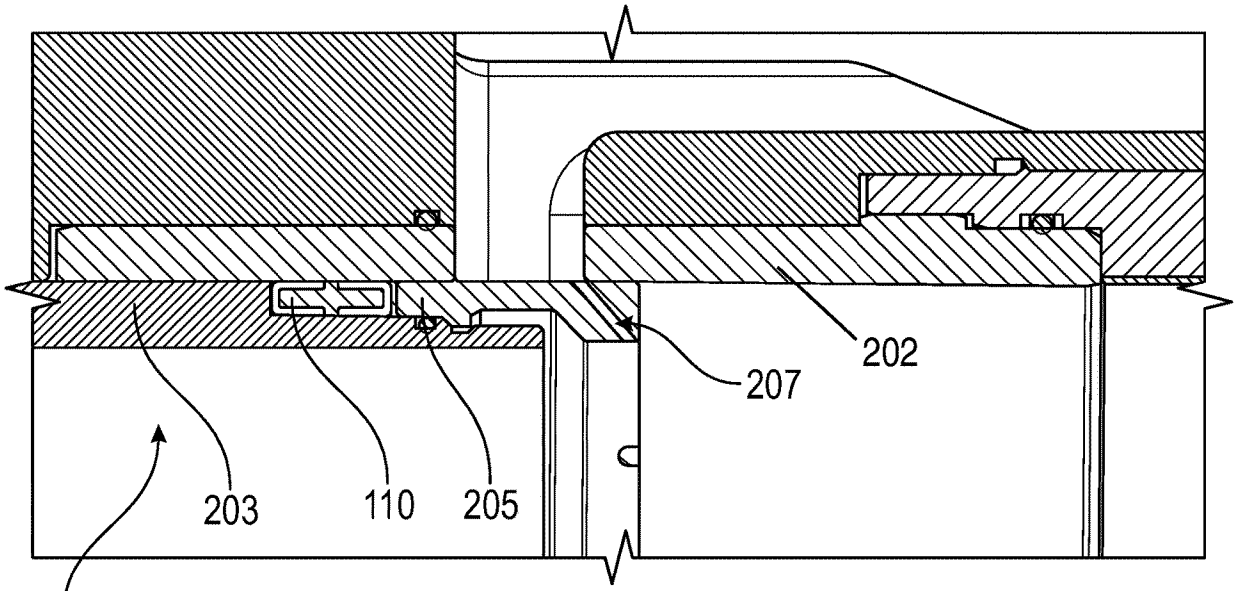
FIG. 10 shows a partial longitudinal cross-sectional view of another example continuous choke section.

FIG. 10 illustrates another example continuous choke. In the illustrated configuration, the piston 204 includes a body portion 203 and an end piece 205 (also shown in FIG. 11) coupled to a distal end of the body portion 203. In other configurations, the end piece 205 can be monolithic or one piece with the body portion 203. In the illustrated configuration, the end piece 205 is generally cylindrical or ring shaped. The end piece 205 includes one or more slots or channels 207. The slots 207 can extend radially through the end piece 205 at an angle. As shown, the slots 207 can extend from a distal end of the end piece 205 into the end piece 205. The angled slots 207 can form generally triangular shaped cut outs as shown. The slots 207 can be angled such that the slots 207 extend into the body of the end piece 205 to a greater extent at or on an outer diameter or surface of the end piece 205 than at or on an inner diameter or surface of the end piece 205.

The slots 207 advantageously allow for more precise control of flow. The slots 207 provide well defined flow paths and advantageously channel energy of the flow away from sensitive areas, for example to help prevent, inhibit, or reduce erosion. The slots 207 can act as, or similar to, jets. Jets allow flow to be more controllable. The flow can therefore be steered away from sensitive areas, such as sealing surface(s) (e.g., of the inner surface of the sleeve 202), to minimize or reduce erosion. Erosion is low on jet walls because the flow is parallel to the wall. In the illustrated configuration, the jets are pointed at an angle toward the center of the flow passage 112. Flow is slowed down, and opposing jet flows cancel each other at the center. The slots 207 enable fine control of a low percentage of the flow. For example, the slots 207 can allow for precise control of about 5% of the total flow area. When only a small flow area is open, flow is the fastest, creating the most aggressive flow conditions. The number of slots can be adjusted to control more or less than 5% of the flow.

Figure 12:
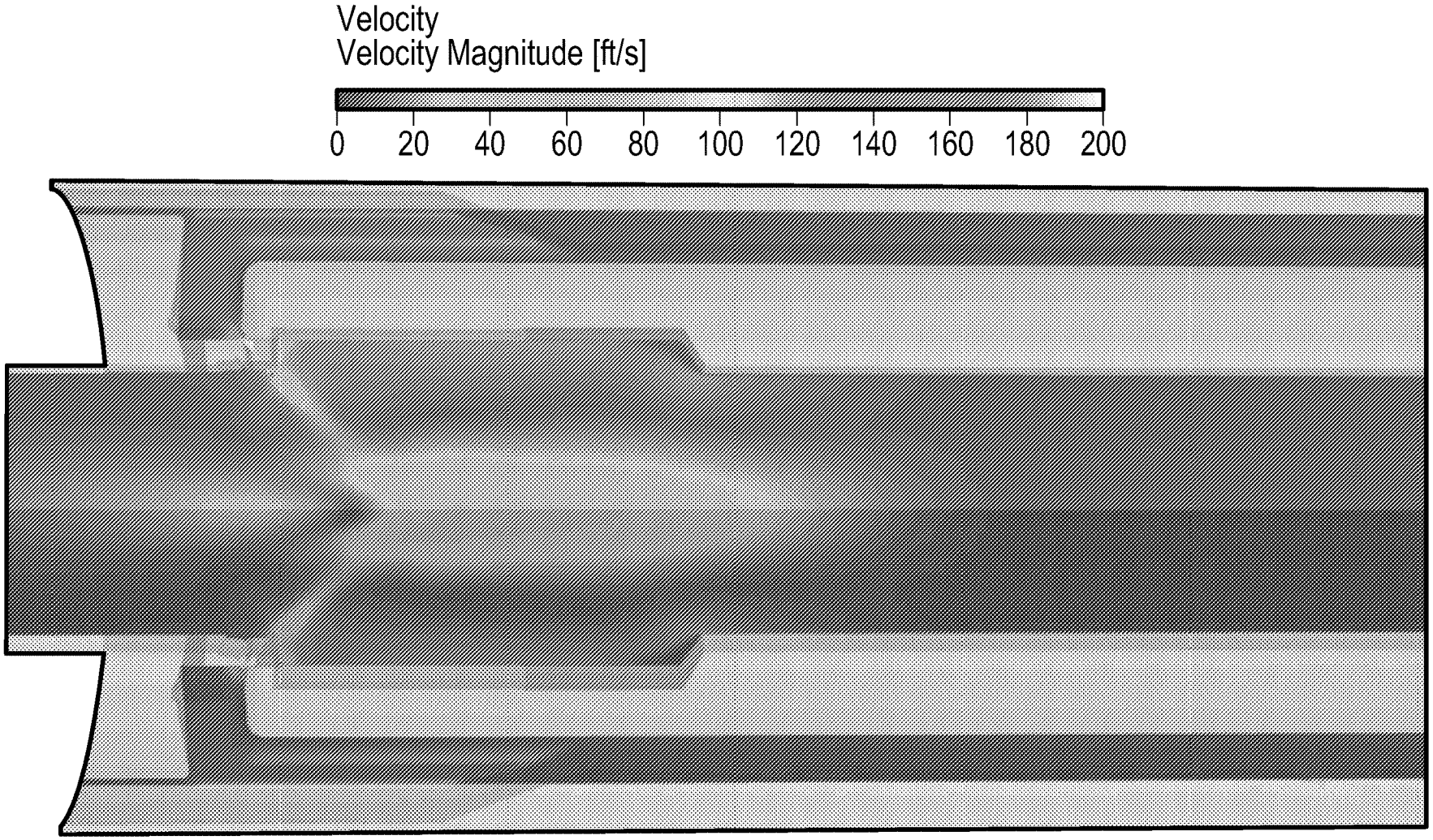
FIG. 12 shows a flow velocity profile of the continuous choke of FIG. 10.

FIG. 12 shows a flow velocity profile of the continuous choke of FIG. 10 in the first position. As the piston 204 moves from a fully closed position toward a full open position, a greater area of the slots 207 along the outer surface of the end piece 205 is progressively uncovered. The jets therefore grow and shrink in size as the piston 204 moves left and right toward the open and closed positions, respectively. The slots 207 may allow the choke to be less sensitive to eccentricity.

The end piece 205 can be carbide, e.g., tungsten carbide. At least the portion of the sleeve 202 that the end piece 205 underlies in use, for example, a distal end portion of the sleeve 202, can be carbide, e.g., tungsten carbide. Having both the end piece 205 and the sleeve 202 (or portion of the sleeve 202 that the end piece 205 underlies) be tungsten carbide allows for a very small radial gap between them, as tungsten carbide is a hard material that thermally expands less than other materials, such as metal, and is conducive to grinding to very accurate dimensions. Minimizing or reducing the radial gap between the piston 204 (e.g., the end piece 205) and the sleeve 202 can help prevent, minimize, or reduce secondary or leakage flows, which helps minimize or reduce erosion.

The seal 110 can be disposed along or in the outer surface of the piston 204 as shown. In the illustrated configuration, the seal 110 is positioned proximal to the end piece 205, for example, axially between the end piece 205 and a portion of the body portion 203. Locating the metal seal 110 along the inner sleeve 204, for example, in a cavity or recess in the outer surface of the piston 204 as shown, can advantageously help keep the seal 110 out of the way of flow and protect the metal seal 110 from flow, and possible erosion, in all flow conditions or positions. The sleeve 202 (or at least a portion of the sleeve 202 that the seal 110 underlies in use) can be carbide, e.g., tungsten carbide, to provide an erosion resistant seal surface. In configurations in which the seal 110 is disposed along or in the outer surface of the piston 204, the seal 110 can also act as a centralizing ring to help centralize the piston 204 relative to the outer sleeve 202 such that the radial gap between the piston 204 and sleeve 202 is uniform about the circumference of the sleeves. The end piece 205 can function as a bearing.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A system for use in a well, comprising:

a fully electric, full bore flow control valve comprising a continuous choke comprising:

a housing comprising at least one opening;

a sleeve comprising at least one opening aligned with the at least one opening of the housing;

a piston slidable relative to the sleeve to progressively cover or uncover the at least one opening of the sleeve to progressively decrease or increase, respectively, flow through the continuous choke, wherein the piston is configured to slide distally relative to the sleeve to move toward a closed position, the piston comprising:

an end piece coupled to a body portion; and a plurality of channels formed in the end piece and configured to direct fluid flow;

one or more sealing features configured to help seal a volume outside the flow control valve from a volume inside the flow control valve when the piston is in the closed position; and an electrically powered actuator operably connected to the piston, the electrically powered actuator configured to respond to electrical inputs to shift the piston to desired flow positions.

2. The system of claim 1, wherein at least a portion of the piston comprising the plurality of channels comprises tungsten carbide.

3. The system of claim 1, wherein at least a portion of the sleeve comprises tungsten carbide.

4. The system of claim 1, wherein the plurality of channels are angled to direct flow toward a center of an axial flow path through the choke.

5. The system of claim 1, wherein the end piece and at least a portion of the sleeve that the end piece underlies in use comprise tungsten carbide.

6. The system of claim 1, wherein the one or more sealing features comprises a metal seal.

7. The system of claim 6, wherein the metal seal is disposed along an outer surface of the piston.

8. The system of claim 7, wherein the metal seal is positioned proximal to the plurality of channels.

9. The system of claim 6, wherein the sleeve comprises a sealing surface against which the metal seal seals when the choke is in a closed position, and the sealing surface comprises tungsten carbide.

10. The system of claim 1, wherein at least one of a radially outer perimeter of the at least one opening of the housing, a radially inner perimeter of the at least one opening of the sleeve, and a free end of the piston comprise a rounded profile.

11. The system of claim 1, wherein the electrically powered actuator comprises an electro-mechanical actuator (EMA).

12. The system of claim 1, wherein the flow control valve is mounted along a well tubing, the flow control valve having a flow area equivalent to an internal cross-sectional area of the well tubing.

13. A method of operating the system of claim 1, the method comprising operating the actuator to cause translational movement of a drive shaft of the actuator, translational movement of the drive shaft causing translational movement of the piston to selectively adjust flow through the flow control valve.

14. A continuous choke for a flow control valve, the continuous choke comprising:

a housing comprising at least one opening;

a sleeve disposed within the housing and comprising at least one opening aligned with the at least one opening of the housing;

a piston disposed within and slidable relative to the sleeve to progressively increase or decrease flow through the choke, the piston comprising:

an end piece coupled to a body portion; and a plurality of channels formed in the end piece and configured to control fluid flow; and one or more sealing features configured to help seal a volume outside the flow control valve from a volume inside the flow control valve.

15. The continuous choke of claim 14, further comprising at least one flow deflector configured to deflect flow through the at least one opening of the housing and the at least one opening of the sleeve away from at least one of the one or more sealing features.

16. The continuous choke of claim 15, wherein the end piece comprises tungsten carbide.

17. The continuous choke of claim 14, wherein at least one of a radially outer perimeter of the at least one opening of the housing, a radially inner perimeter of the at least one opening of the sleeve, and a free end of the piston comprise a rounded profile.

18. A flow control valve comprising the continuous choke of claim 14, wherein the flow control valve is mounted along a well tubing, the flow control valve having a flow area equivalent to an internal cross-sectional area of the well tubing.

* * * * *